United States Patent [19]

Powell et al.

[11] Patent Number: 4,821,647

[45] Date of Patent: Apr. 18, 1989

[54] DOWNHILL TUBULAR GUIDEWAY HAVING AN AIR SUSPENSION SYSTEM FOR PASSENGER CAR

[76] Inventors: Tyrone E. Powell, 1048 W. International Airport Rd., Anchorage, Ak. 99518; George Ladyman, 302 Tradd St., Mauldin, S.C. 29662

[21] Appl. No.: 168,971

[22] Filed: Mar. 16, 1988

[51] Int. Cl.[4] ..... A63G 31/00; B61B 13/10; B61L 1/00

[52] U.S. Cl. ..... 104/23.2; 104/69; 104/125; 104/134; 104/138.1; 104/250; 246/201

[58] Field of Search ..... 104/53, 59, 69, 73, 104/23.1, 23.2, 134, 138.1

[56] References Cited

U.S. PATENT DOCUMENTS

| | | | |
|---|---|---|---|
| 3,675,582 | 7/1972 | Girard et al. | 104/23.1 |
| 3,837,285 | 9/1974 | Goering | 104/23.2 |
| 4,027,596 | 6/1977 | Nardozzi, Jr. | 104/138.1 |
| 4,231,294 | 11/1980 | Arzoumanian | 104/138.1 |
| 4,236,454 | 12/1980 | Erickson et al. | 104/69 |
| 4,335,658 | 6/1982 | Vanderkelen | 104/69 |
| 4,703,697 | 11/1987 | Bell | 104/23.1 |

FOREIGN PATENT DOCUMENTS

| | | | |
|---|---|---|---|
| 1474851 | 2/1967 | France | 104/23.2 |

*Primary Examiner*—Johnny D. Cherry
*Assistant Examiner*—Joseph D. Pape
*Attorney, Agent, or Firm*—Richard C. Litman

[57] ABSTRACT

An amusement ride down a ramp containing two air suspension flumes and a return conveyor belt system. The ramp is in a climate controlled transparent housing. There is ducting in the ramp for air conditioning, compressed air, and other possible fluid needs along the ramp and at its top portion. The upper half of the housing may be transparent. The cars have a transparent canopy and enclose room enough for three passengers. The ramp has modular sections supported by stanchions the height of which are hydraulically adjustable by automatic sensing devices; possibly using laser light or other types of electrical sensing apparatuses.

13 Claims, 5 Drawing Sheets

FIG. 6
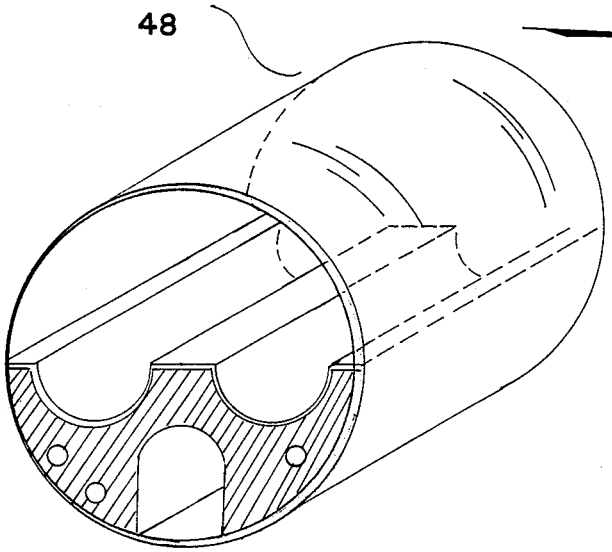
FIG. 5
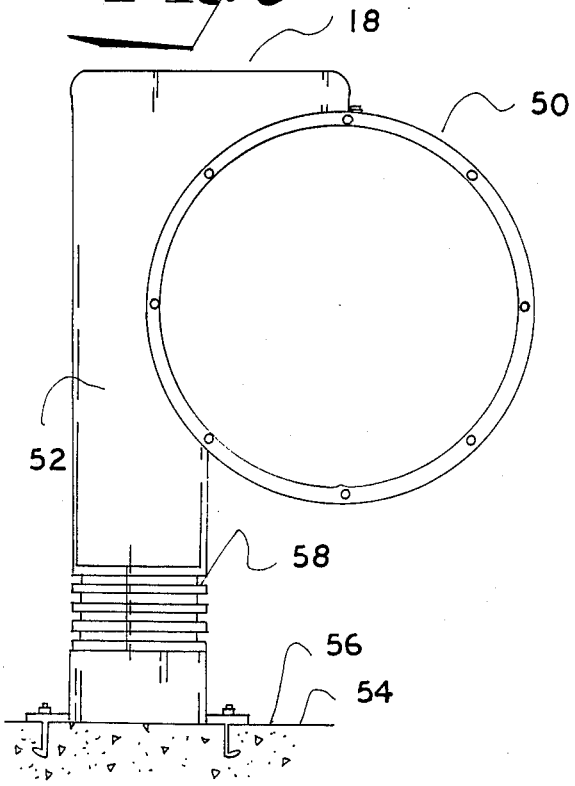
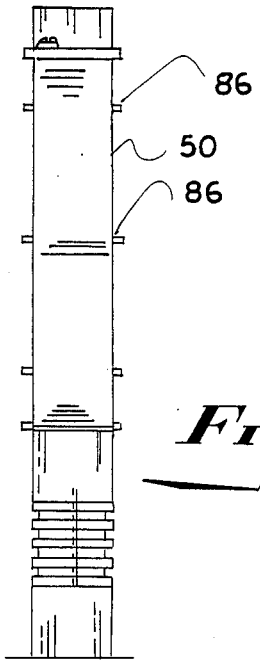
FIG. 7

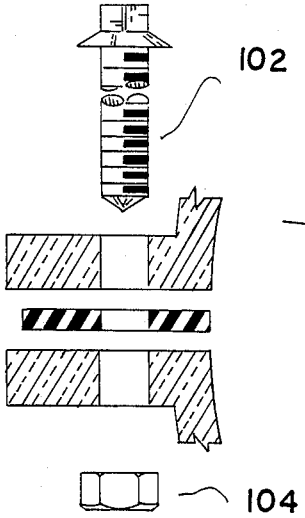
FIG. 12
FIG. 11
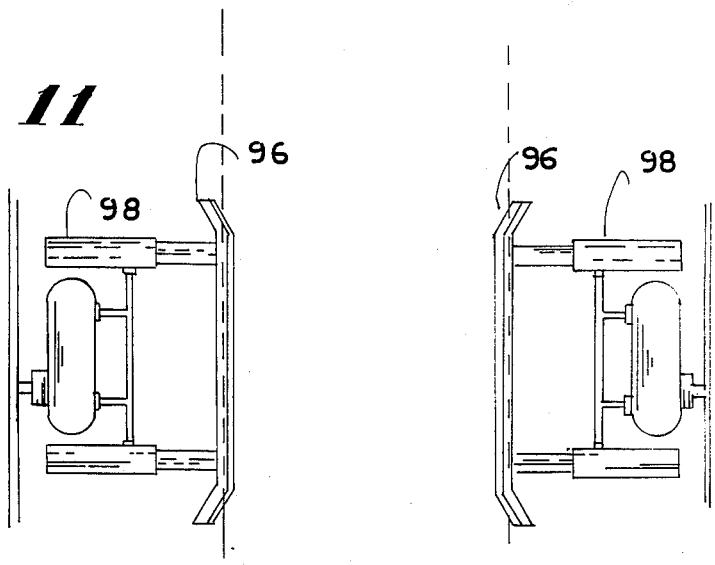
FIG. 13
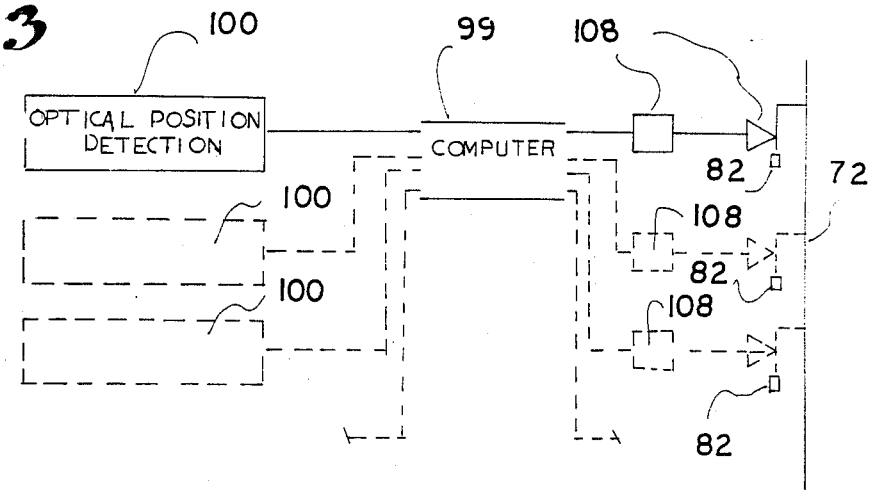

DOWNHILL TUBULAR GUIDEWAY HAVING AN AIR SUSPENSION SYSTEM FOR PASSENGER CAR

FIELD OF THE INVENTION

Amusement rides are, of course, many in types and numbers. They usually are cars carried on wheels and frequently, like roller coasters, are drawn by gravity down meandering paths on some sort of rail guiding system. The amusement ride of the present invention is intended to be used at large ski resorts, amusement parks and areas of large vertical drops in America, Canada, Europe and Asia. Some ski resorts lack good facilities which the general public can utilize in the summer months. The expensive lift systems at most resorts sit idly by for the most part except in areas where tourists are conveyed to the mountain top for the views of the mountain areas. Winter skiing starts in most resorts around November 15th of each year and ends approximately April 15th of the following spring. It is well noted that even the best resorts do not have the added attractions to draw the crowds in the off-season. A way of broadening the economic base of the resorts is needed as well as also picking up the business slack in the warm months. An environmentally controlled facility would be capable of year around use. Ownership and management will readily recognize the benefits of such improvements to their resorts.

DESCRIPTION OF THE RELATED ART

U.S. Pat. No. 3,970,300 to Freiherr von Wendt, et al. is drawn to a sledding run which is made of overlapping consecutive segments which all go make to up a slide for mountain side resort use.

U.S. Pat. No. 3,100,454 to Dennis is drawn to a high speed ground transportation system which suspends its vehicle aerodynamically in a similar way to the aerodynamics of a high speed close to the ground aircraft. There are no stationary sources of jets of air in Dennis.

U.S. Pat. No. 3,055,312 is drawn to another high speed transportation vehicle which is supported on jets of air not emanating from the surface of a flume but emanating from a surface along a rail or a pair of rails.

U.S. Pat. No. 4,221,170 to Koudelka is drawn to a monorail mountain slide using wheels and adjustably supported rail sections on stanchions.

U.S. Pat. No. 4,335,658 to Vander Kelen is basically a downhill double-rail track using wheeled carts.

U.S. Pat. No. 417,817 discloses a sliding hull and toboggan that features an elevator to raise the cars at the starting point of the ride.

U.S. Pat. No. 386,123 discloses a car on a wheeled toboggan run.

SUMMARY OF INVENTION

This invention is an amusement ride for mountain resorts, amusement parks, and areas of large vertical drops preferably with ski-type lifts already in place. There is a ramp in a climate control housing which envelopes two flumes for increasing numbers of passengers using the flumes per unit time and also envelopes a conveyor system for returning the cars from the bottom portion to the top portion of the slide. The housing is divided into a superstructure and a base structure. The superstructure may be transparent and/or lighted by exotic illumination systems. Cars travel down the flumes on an air suspension system. Lifts shift the cars to and from the conveyor an flumes. Stanchions support sections of the ramp with columnar supports the upper portions of which are variably elevated in height. The variability of the columnar supports is automatically determined by a hydraulic system using sensors to control fluid in the hydraulic system. Shock absorbers are also used in the columnar supports for damping vibration and impulsive loading.

The cars are designed usually for three passengers with one in a more desirable position up front in the nose. There is a transparent canopy protecting and limiting passenger space for a safe interior. There may be control for computer and laser-like games for enjoyment en-route down the flumes.

BRIEF DESCRIPTION OF THE DRAWINGS

FIG. 5 is a front elevation of the stanchion with its columnar support, cantilevered ring and hydraulic height adjusting system.

FIG. 6 is a section of the ramp.

FIG. 7 is a side elevation of a stanchion including pneumatically extended rods.

FIG. 11 is a plan view of the brake system for the bottom portion of the ride to stop the car after an excursion down the ramp.

FIG. 12 is an elevational and fragmented view of the superstructure and base structure held together by a bolt and sealed against the weather.

FIG. 13 is a schematic of the computerized controlled braking and suspension system including electrical and fluid parts of the braking and suspension system.

DETAILED DESCRIPTION OF THE PREFERRED EMBODIMENT

Figure 1:
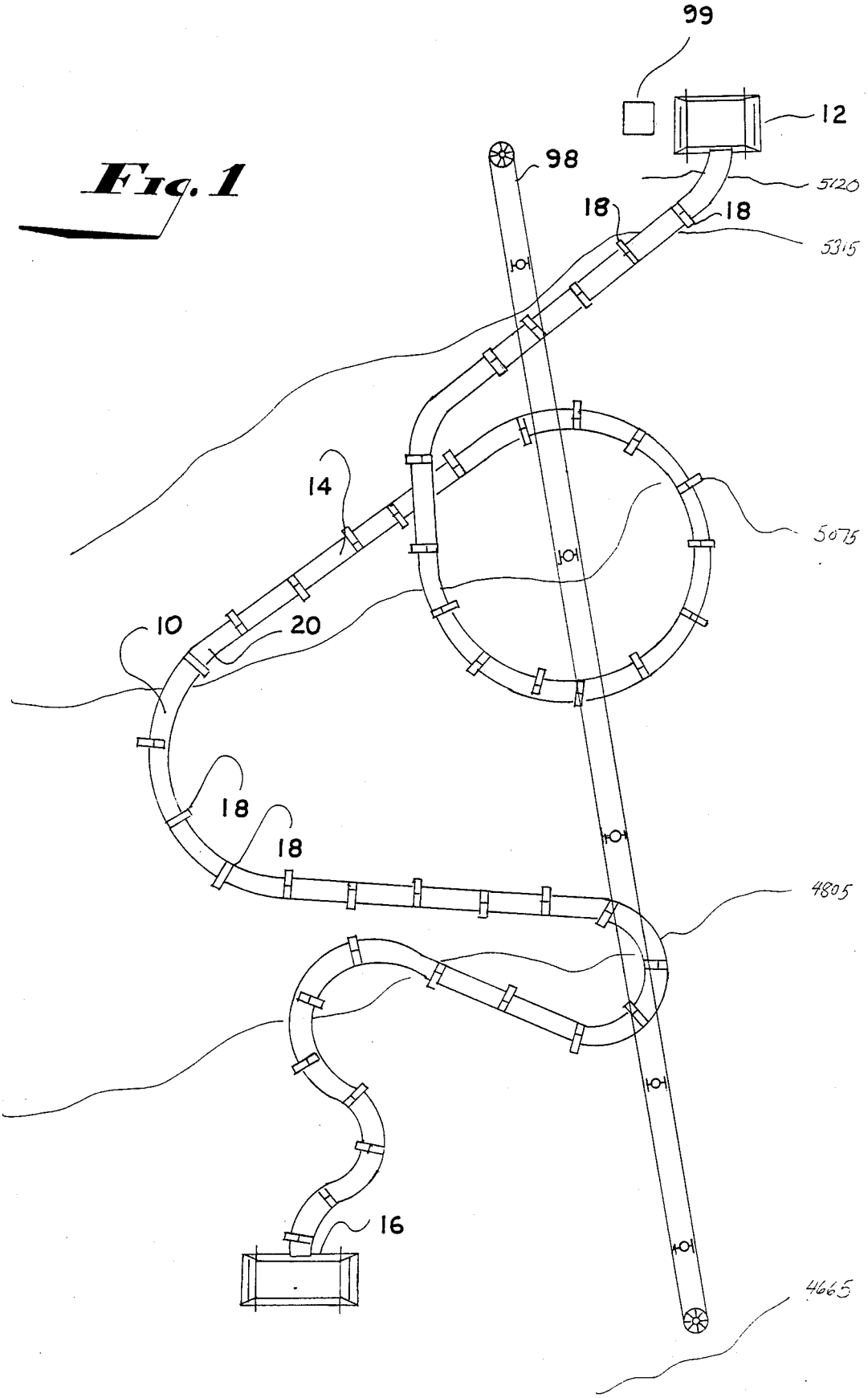
FIG. 1 is a plan view of the ride on a contour map.
Figure 2:
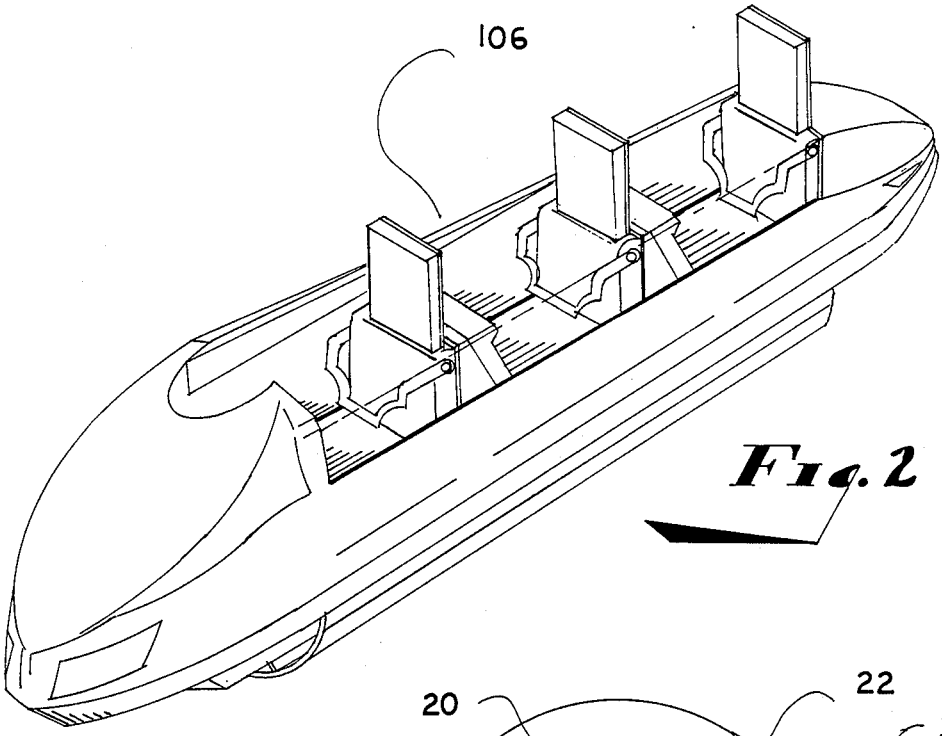
FIG. 2 is a perspective view of one of the cars adapted for use on the air suspension ramp flume.

The amusement ride 10 shown in FIG. 1 in plan on a contour map of a sloping hill or mountainside starts at its top portion 12 and following in a meandering path 14 terminates at the bottom portion 16. There are supporting sequential stanchions 18 at intervals along the meandering path 14 substantially placed alternately on one side of the path to the other side of the path to support a guiding housing 20. Cars 106 preferably of Fiberglas shown in FIG. 2 are slipped down the path 14 in housing 20 on a "cushion" of air. A pre-existing ski lift 98 is also depicted in FIG. 1.

Figure 3:
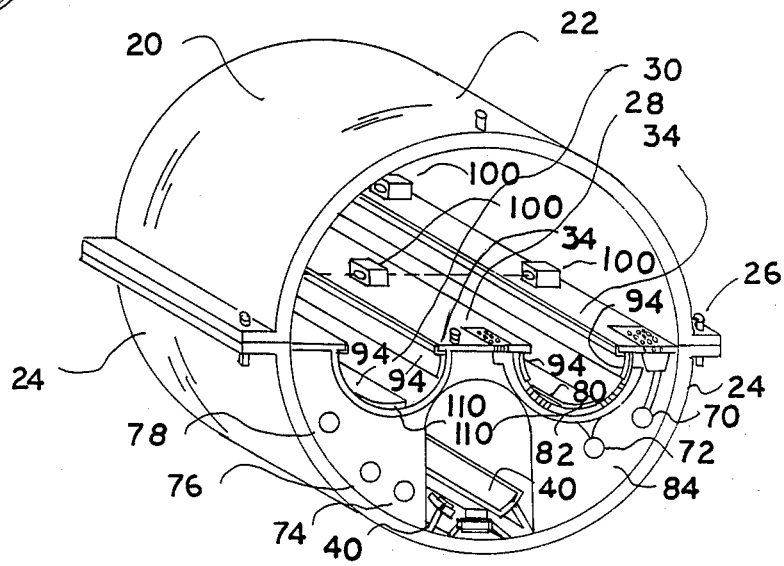
FIG. 3 is a perspective view of a section of the ramp with its flumes and conveyor system with the steering and braking teflon or silicone strips.

FIG. 3 shows the housing 20, which is supported by stanchions 18 above in cross-section; and which, housing 20, is divided into an upper half or superstructure 22 and a lower half or base structure 24 both preferably of Fiberglas. The upper half 22 simply comprises a transparent cover at 22. The lower half 24 bolted with the upper half 22 at 26 comprises a ramp structure 28 including preferably two flumes 30 and 32 formed as concave surfaces, decks 34, access hatch 36 and suitable ducting to be elaborated on latter. Also included in the amp structure 28 is traveling conveyor belt system 38 and holding tracks 40 of telfon or silicon strips on either side of the conveyor belt system 38. Teflon or silicon strips at 40 and 94 brake and steer the cars up and down the ramp on the conveyor and flume. The system 38 is for returning the cars 106 as shown in FIG. 2 from the bottom portion 16 of the meandering path 14 to its top portion 12. There are a plurality of sections 48 modular in form making the housing 20 along path 14.

Figure 4:
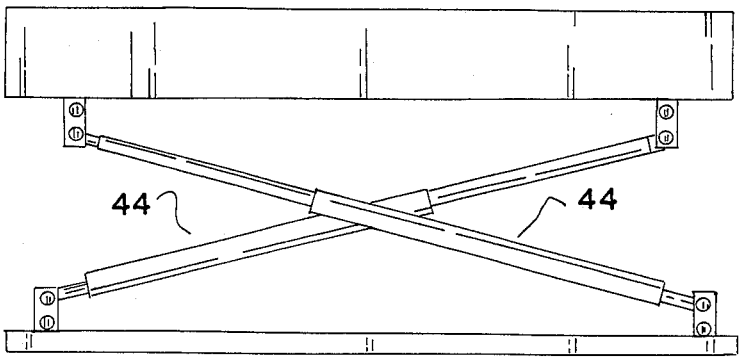
FIG. 4 shows the hydraulic lift for moving the cars in a modified flume section out of and into alignment with the flumes in the ramp proper.

There is provision at the top and bottom portions 12 and 16 for loading and unloading to lift the cars 46 in FIG. 4 up in a modified flume 42 by hydraulic lift elements 44 with appropriate shifting mechanism (not shown) to translate the cars 46 and modified flume 42 over to the positions in alignment and out of alignment with the appropriate flume 42 in the ramp 28 for the respective loading and unloading.

To further elaborate on the stanchions 18, it can be said that in FIG. 5 their height is adjustable and they are integrally fitted in a cantilever fashion with locking rings 50 from a main columnar support 52. The columnar support 52 is embedded in the earth 54 and is preferably set in bed rock but may be set in less firm terrain. The footing of these supports may typically be in concrete 56.

Figure 9:
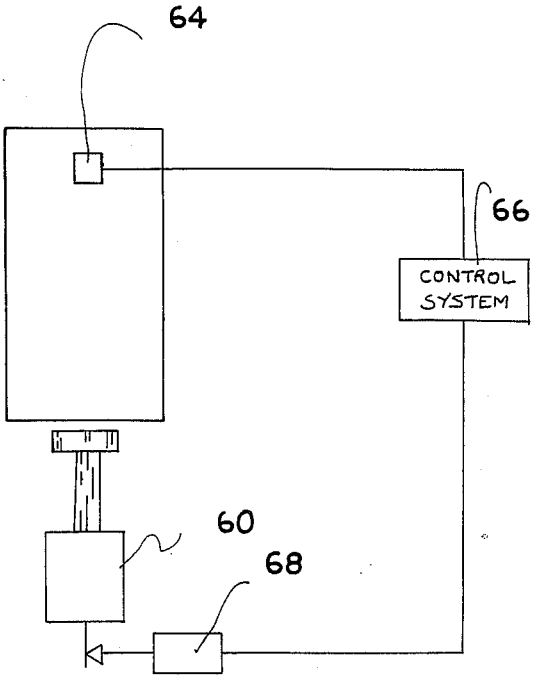
FIG. 9 is a schematic of the control system sensor and hydraulics to determine elevation in the stanchion with its columnar supports.
Figure 10:
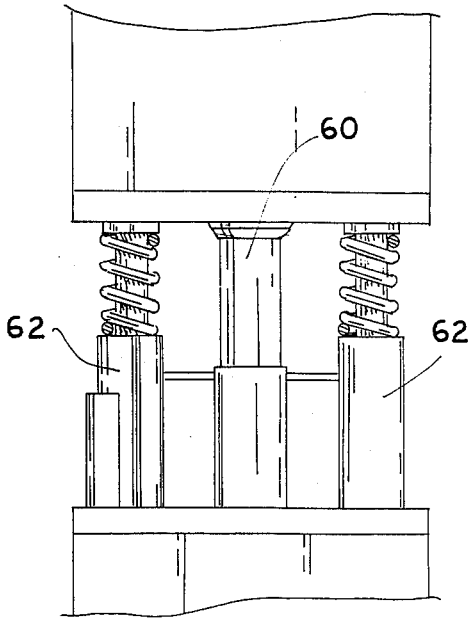
FIG. 10 is a detail view of the shock absorbing system and the hydraulic lift in the columnar support part of the stanchion.

The variability of the height of the support 52 is achieved at 58 by hydraulic piston mechanism 60 shown in FIG. 10 combined in this figure with shock absorbers 62 on either side of the hydraulic piston device 60. The hydraulic piston 60 is controlled by a sensor 64 that may be a laser or other alignment or proximity sensing element that can give a signal when the sections 48 supported by the stanchions 18 are out of alignment and another signal can be nulled or triggered by a control-type system 66 for adjusting the height by the hydraulic piston 62, for example, controlling a valve 68 to the piston-cylinder chamber 60 as shown in FIG. 9.

It should be mentioned that the footing of the stanchions 18 may shift with changes of moisture content of the ground, freezing and other variables that can cause geological instability so that it is important to render better alignment of the modular sections 48 by their adjustable height as with hydraulic piston cylinder 62. The sensor system of FIG. 9 allows the adjustment to be done automatically and continuously making the ride have optimal performance. Shock absorbers are included in proximity to the piston to dampen vibration and impulsive loading.

As to the ducting work mentioned above in the description of FIG. 3 there are ducts for air conditioning 70 the purpose of which is self-explanatory, duct of compressed air 72 to support the cars, electrical ducting 76 and ducts for sewage 78 which will be explained. Restaurants at the upper portion may require facilities for passenger comfort. Such ducting will make these facilities more easily installed and serviced and represents a solution for such a long standing problem to have facilities in, for instance, such a restaurant. There may be a duct 74 included for any future miscellaneous purpose just to accommodate unforeseen uses of the ramp 28.

Apertures 80, fed by plenums 82 throughout the expanse of the flumes, render streams of air to support the cars 106.

Figure 8:
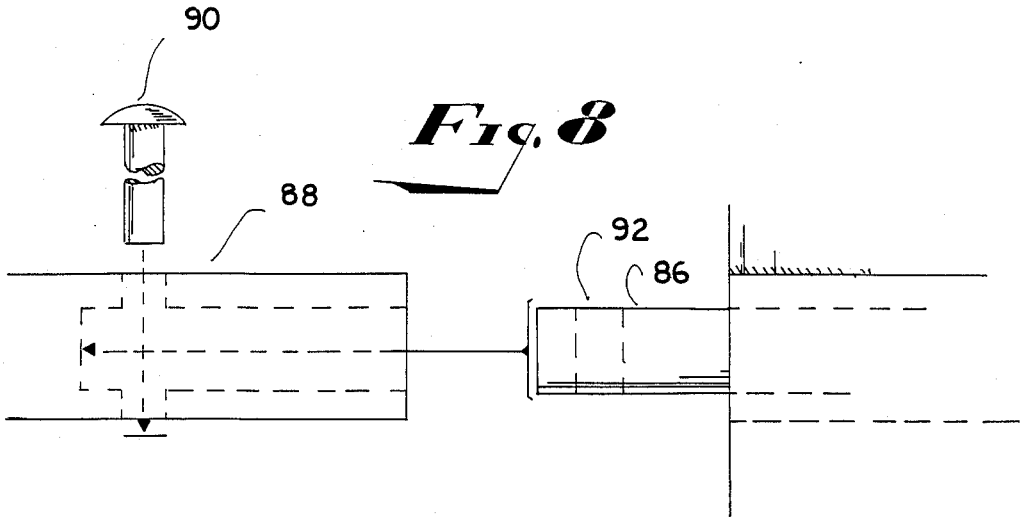
FIG. 8 show the rod before entry and a pin for locking the rod in position in a lip of the modular ramp section.

All of the ducts extend from bottom portion 16 to top portion 12 through the plurality of sections and through the various supported brackets 84 which supports the flumes 30 and 32, ducting 70, 72, 74, 76, and 78 and deck 34. The various sections 48 are held in fabrication to the stanchions 18 supported by rings 50 by connecting rods 86, that may be extended by air pressure during fabrication. Rods 86, when extended, fit in an opening in a lip 88 of each end of each section 48 as shown in FIG. 8. A pin 90 is inserted through a hole 92 in rod 86 and by restricting said rod 86 in place from withdrawal from the lip 88, the rod 86 is held in place with the stanchion's ring 50 supporting the held section 48. Each stanchion 18 supports the ends of two different consecutive sections 48.

FIG. 11 is a plan view of the brake system 96 driven by a hydraulic system 98. The action is to squeeze and position the car.

FIG. 12 is a fragmented view of how the superstructure 22 and base structure 24 are bolted together with a rubber gasket 101. A bolt 102 and nut 104 are used to fasten in the familiar manner.

In FIG. 1 and FIG. 13 a computer is placed in the vicinity of the ride at 99 optionally near the top portion of the ramp. In FIG. 3 optical sensors 100 chosen as just for one form of position detecting means for rendering an output signal significant of the location of the individual cars by interruption of light beams in the flumes 42. The computational means at 99 in FIG. 13 controls the air fed to the flumes in plenums 82 for suspending the cars on the "air cushion" into and out of contact with the steering and braking strips 94 and 110 in FIG. 3 to control the rate of descent and spacing of the cars. It also allows only a limited amount of total airflow to the flume to only those locations where the light beams are interrupted. The airflow may be controlled by solenoid valves 108 in FIG. 13 for the airstreams at particular locations in the flumes.

I claim:

1. In an amusement ride for at least one car a combination comprising;

means for guiding said at least one car comprising a ramp, and at least one flume with a concave surface arranged in said ramp;

said ramp having a top portion and a bottom portion;

means for housing said at least one flume in said ramp including a superstructure above and a base structure below holding the superstructure;

means for supporting said means for housing including sequential stanchions;

said means for housing being in modular form including a plurality of sections with two ends; each of said sections has a part of the superstructure with its corresponding part of the base structure;

and means in said flume for supporting said at least one car separated from the concave surface of the flume on a stream of air fed to the flume under pressure.

2. In the amusement ride of claim 1 said combination further comprising;

first means for loading said at least one car at said top portion of said ramp into alignment with said at least one flume, and second means for unloading said at least one car at said bottom portion of said ramp out of alignment with said at least one flume.

3. In the amusement ride of claim 2 said combination further comprising;

traveling means in said housing for sending said at least one car from the bottom portion of the ramp up to the top portion of said ramp, second means for loading said at least one car at the bottom portion of said ramp into said traveling means, and second means for unloading said at least one car at the top portion of said ramp out of said traveling means.

4. In the amusement ride combination of claim 1 wherein, said means for guiding includes at least one meander.

5. In the amusement ride of claim 1 said combination wherein said each of said sections is supported at said ends by two consecutive stanchions of said sequential stanchions.

6. In the amusement ride of claim 5 the combination further comprising;

a rod served to extend from said stanchion by air pressure when said sections are fabricated to be supported by said stanchions, and a lip on said section into which said rod extends.

7. In the amusement ride of claim 6 the combination further comprising;

said rod held in place by a pin placed to restrict said rod from withdrawal from said lip.

8. In the amusement ride of claim 5 said combination wherein;

each of said sequential stanchions has a columnar support embedded in the earth; and within said columnar support is a hydraulic piston mechanism to provide variability of height to said ends of said sections.

9. In the amusement ride of claim 8 said combination further comprising;

shock absorbing means for damping vibration and impulsive loading situated in proximity to said hydraulic piston mechanism.

10. In the amusement ride of claim 8 said combination further comprising;

sensor means for determining alignment of said sections a control system for regulation of hydraulic fluid to said hydraulic piston mechanism in response to said sensor means.

11. In the amusement ride of claim 1 said combination further comprising;

braking and steering strips in the bottom and sides of said at least one flume.

12. In the amusement ride of claim 1 said combination further comprising;

position detecting means having output signals located in said flume for determining the position of said at least one car in said flume.

13. In the amusement ride of claim 11 said combination further comprising;

computational means for receiving said output signals and for controlling said stream of air fed to said position and thereby controlling the descent of said car with said braking and steering strips.

* * * * *